United States Patent [19]

Dickerson

[11] Patent Number: 4,850,059

[45] Date of Patent: Jul. 25, 1989

[54] APPARATUS FOR PREVENTING BACKING UP OF SEWAGE IN A BUILDING

[75] Inventor: James A. Dickerson, Charlotte, N.C.

[73] Assignee: Jim Dickerson Plumbing, Inc., N.C.

[21] Appl. No.: 195,131

[22] Filed: May 17, 1988

[51] Int. Cl.[4] ..... E03D 9/04; E03F 5/08

[52] U.S. Cl. ..... 4/211; 4/219; 137/527.6; 137/527.8

[58] Field of Search ..... 4/206, 211, 216, 209 R, 4/219, 295; 137/247.19, 356, 527.6, 527.8; 220/335, 337

[56] References Cited

U.S. PATENT DOCUMENTS

| | | | |
|---|---|---|---|
| 616,252 | 12/1898 | Pennie | 137/527.8 |
| 1,107,096 | 8/1914 | Mulloy, Sr. | 137/527.8 |
| 1,626,969 | 5/1927 | Reeves | 137/383 |
| 1,837,322 | 12/1931 | Hamilton | 137/527.8 |
| 1,898,250 | 2/1933 | Joiner | 137/527.8 |
| 1,908,819 | 5/1933 | Boosey | 137/527.8 |
| 1,917,000 | 7/1933 | Tyden | 251/298 |
| 2,089,141 | 8/1937 | Wasserman | 137/247.19 |
| 2,711,188 | 6/1955 | Nickerson | 137/527.8 |
| 2,882,923 | 4/1959 | Smolensky | 137/527.8 |
| 2,934,084 | 4/1960 | Adams | 137/527.8 |
| 3,603,340 | 9/1971 | Rousselet | 137/357 |
| 3,941,151 | 3/1976 | Biddle | 4/211 |
| 4,114,641 | 9/1978 | Robinson et al. | 137/430 |
| 4,261,386 | 4/1981 | Young | 137/467 |
| 4,475,571 | 10/1984 | Houston, Jr. et al. | 137/430 |

*Primary Examiner*—Henry J. Recla
*Assistant Examiner*—J. Casimer Jacyna
*Attorney, Agent, or Firm*—Bell, Seltzer, Park & Gibson

[57] ABSTRACT

A waste sewage system for a building constructed to prevent sewage from backing up within the building. A valve is connected to an end of a clean-out conduit line of a waste sewage system for normally closing the same and openable in response to sewage effluent backing up within the clean-out conduit line. The valve comprises a tubular body portion having one end connectable to the end of a clean-out conduit line, a cover pivotally mounted on the body portion and normally closing the other end of the body portion, and sealing means carried by the body portion and cooperating with the cover to minimize escapement of noxious sewer gases.

5 Claims, 2 Drawing Sheets

APPARATUS FOR PREVENTING BACKING UP OF SEWAGE IN A BUILDING

FIELD OF THE INVENTION

The present invention relates to an apparatus for preventing backing up of sewage through fixtures in a building in the event of blockage in a sewer line.

BACKGROUND OF THE INVENTION

A main sewer line typically serves multiple buildings with individual outflow lines extending from the buildings and connecting the waste receiving fixtures such as toilets, sinks and the like of the building with the main sewer line. A potential problem with such a system is that either the main sewer line or the outflow lines may become clogged. When this occurs, raw sewage may back up into the fixture or fixtures of a building, which are located at a lower elevation in the building than the other fixtures. As is well known, the overflow of raw sewage in such fixtures can be highly hazardous to the health of the occupants and can cause a great deal of damage to the building.

This is a particular problem with respect to modern apartment and condominium buildings in that the tenant having fixtures at the lowest point such as the one on the ground floor will have raw sewage backing up into their home not only from the main sewer line but also the sewage from the other tenants. Often the first symptom of a clog problem is the sewage backing up in a fixture or fixtures, thus once the problem has been recognized it is too late to prevent the hazard and damage.

Heretofore, there have been no suggestions for obviating this problem other than unclogging the system once the sewage has begun to back up, which is too late.

SUMMARY OF THE INVENTION

In accordance with the present invention, applicant provides an apparatus for preventing the backing up of sewage through the waste receiving fixtures of a building in the event of blockage. The present invention is adapted to be used as part of a waste removal system. The apparatus comprises a valve normally closing an upper end of a clean-out conduit line connected to the sewage outflow conduit line. The sewage outflow conduit line extends from the building and connects the waste conduit line and waste receiving fixtures of the building to the main sewer line. The normally closed valve is opened in response to sewage effluent backing up within the sewage outflow conduit line and substantially filling said clean-out conduit line whereby the problem of sewage effluent backing up through the fixture within the building is avoided.

BRIEF DESCRIPTION OF THE DRAWINGS

The foregoing and other objects, features and advantages of the present invention will be made apparent from the following detailed description of the preferred embodiment of the invention, and from the drawings, in which.

DETAILED DESCRIPTION OF THE INVENTION

Figure 1:
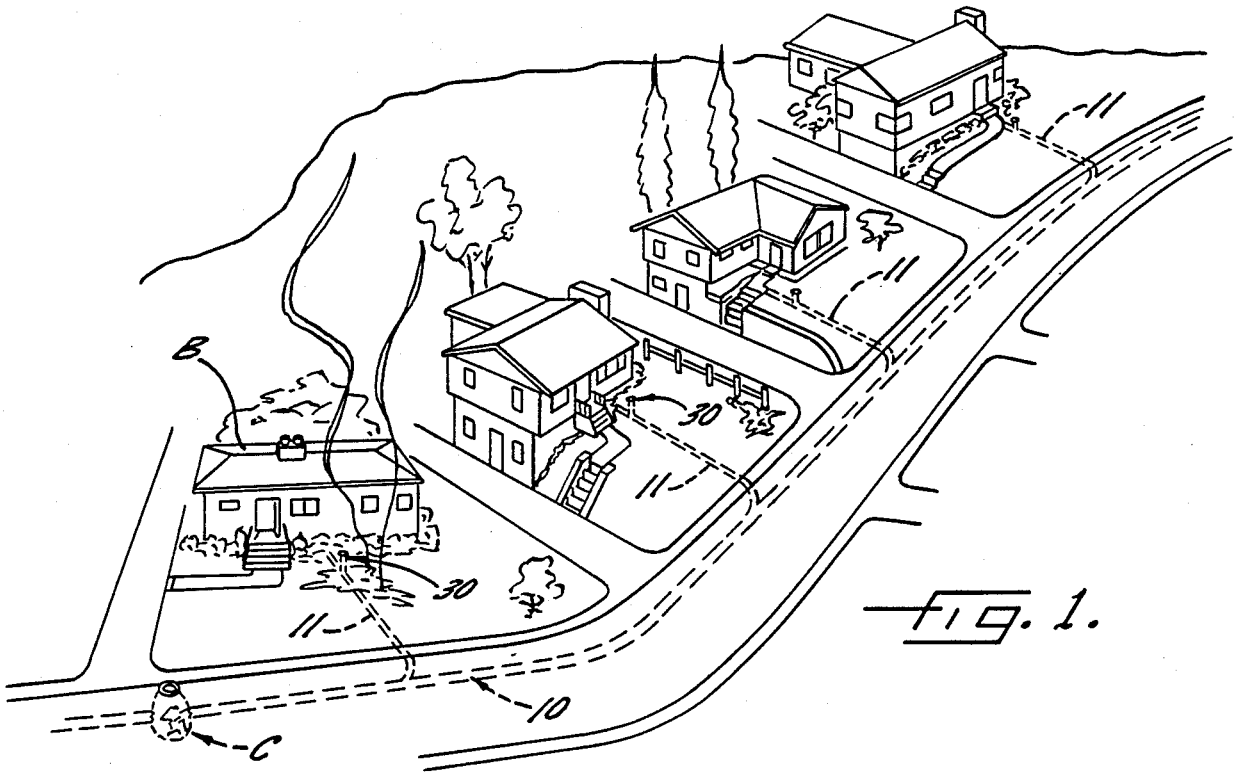
FIG. 1 is an environmental view illustrating a neighborhood and the waste removal system thereof including a main sewer line extending along the street and individual sewage outflow lines connecting the waste receiving fixtures of the houses with the main sewer line.

Referring more particularly to the drawings, FIG. 1 depicts a typical neighborhood and a waste removal system serving it. A main sewer line 10 extends along the street and is connected to each building B such as the illustrated houses or buildings through individual sewage outflow conduit lines 11. Waste normally flows from the houses by positioning the sewage outflow conduit lines on a grade thereby using gravity to cause the sewage effluent to flow away from the respective building to the common main sewer line.

A potential problem is that the main sewer line 10 can become blocked by a cave-in C or any other obstruction. When this occurs, sewage effluent will back up into the sewage outflow conduit line 11 and will eventually enter the building situated at the lowest elevation in the sewer line. A similar situation occurs if an individual sewage outflow conduit line 11 becomes clogged. The end result is that raw sewage will eventually back up to such extent that it will back up into the waste receiving fixtures 12 on the lowest floor of the building and particularly the fixture or fixtures located at the lowest elevation compared to the location of other fixtures. It is easily recognized that this can be an acute problem in a large building such as a large complex of apartments or condominiums where not only will the raw sewage of the main sewer line 10 back up into the lowest located fixture but also any sewage disposed in the fixtures at a higher elevation than the lowest one.

Figure 2:
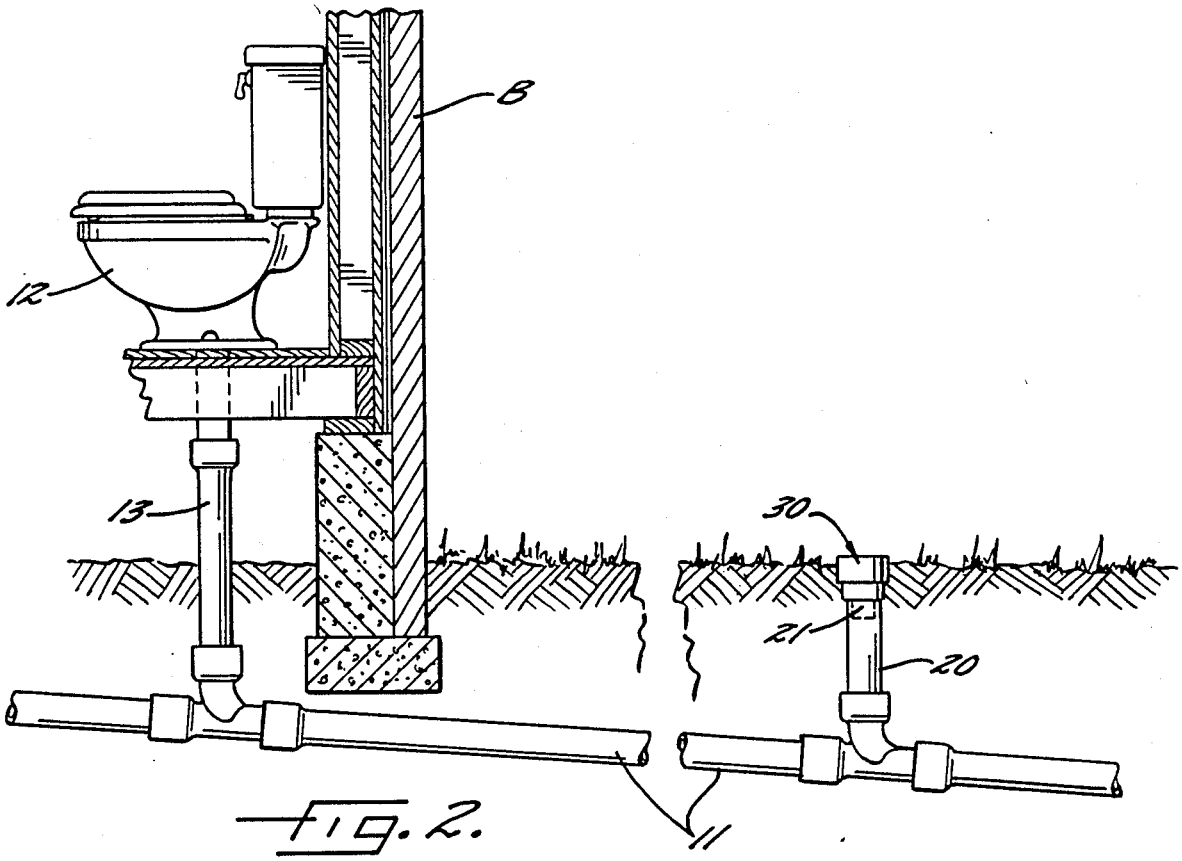
FIG. 2 is a vertical sectional view illustrating an exemplary waste removal system.
Figure 3:
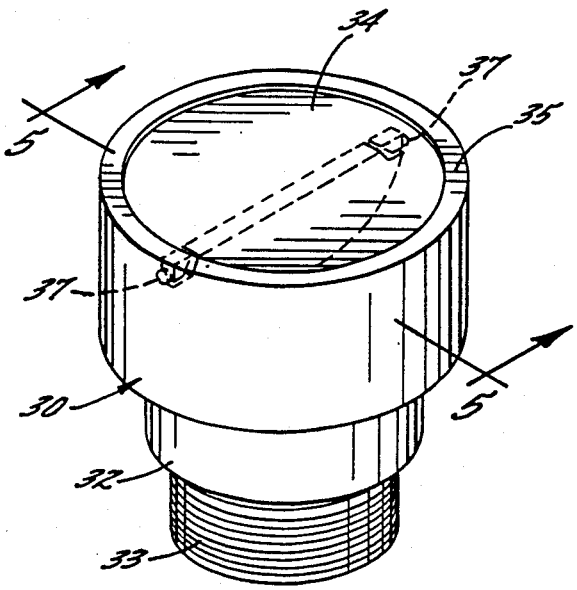
FIG. 3 is an enlarged perspective view of the valve.
Figure 4:
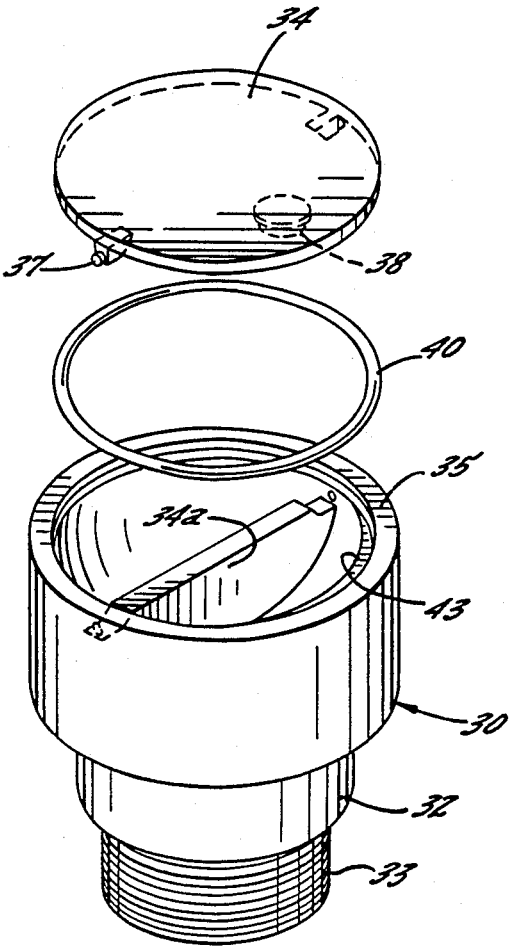
FIG. 4 is an enlarged perspective view of the valve with the cover and O-ring removed therefrom.

FIG. 2 illustrates a basic waste removal system. A waste receiving fixture 12 such as a toilet or sink within the building is connected through a waste conduit line 13 to the sewage outflow conduit line 11 and extends from the building and connects to the main sewer line 10. The sewage outflow conduit line 11 is positioned on such a grade that sewage will flow away from the building into the main sewer line by gravity.

A clean-out conduit line 20 is also connected to the sewage outflow conduit line 11 and extends upwardly therefrom and terminates at an elevation below the level of the waste receiving fixture 12 in the building. Clean-out conduit lines 20 are provided to facilitate cleaning out any blockage occurring downstream of the clean-out line 20 in the sewage outflow conduit line 11 using a tool snaked down the line. The clean-out lines are typically required by building codes to be located at a minimum of 10 feet from the house, and a similar clean out line would be provided about every 40 feet and to the main sewer line. Conventional clean-out conduit lines 20 are capped, and are often difficult to locate because they become overgrown with grass or weeds. To my knowledge, a conventional clean-out line 20 does nothing to obviate any sewage back up problems caused by blockage other than to permit a plumber, once the blockage has been discovered, to attempt to clear the sewage outflow conduit line.

According to this present invention a means 30 in the form of a valve is shown communicatively connected to each clean-out line 20 for preventing backing up of sewage effluent through the fixtures 12 in each respective building in the event of a blockage downstream of the release means. As shown in detail in FIGS. 3–6, it will be seen that the valve 30 normally closes the upper end 21 of the clean-out line 20. The valve 30 comprises a body portion 32 which is preferably tubular and may be molded of a hard, durable plastic, such as polyvinylchloride (PVC). The body portion 32 preferably has molded external threads 33 thereon so that the body portion can be easily threaded into the upper end 21 of the clean-out line 20. It is recognized that other non-thread type connections may be used such as a snap fit or the like. The body portion 32 includes a partition **34*a* integrally formed with the body portion and underlying a cover 34. This partition 34*a* is typically plastic and integrally formed with the body portion 32. The partition isolates a portion of the interior of the body portion 32 from flow of effluent therethrough and also serves for limiting the angular movement of the cover 34 to an open position. As illustrated this partition 34A is positioned to be engaged by the underside of the cover 34 to prevent the cover 34 from being moved to a vertical position, and thus stops the cover 34**, wherein the cover is in an over balanced position to be urged to a closed position.

Figure 5:
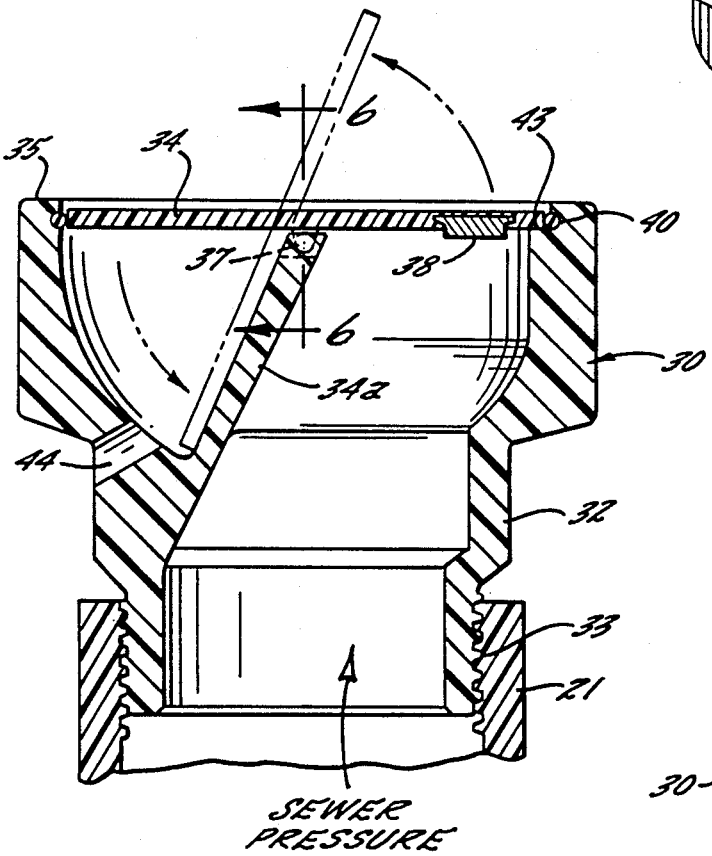
FIG. 5 is a vertical sectional view of the valve taken along line 5—5 of FIG. 3.
Figure 6:
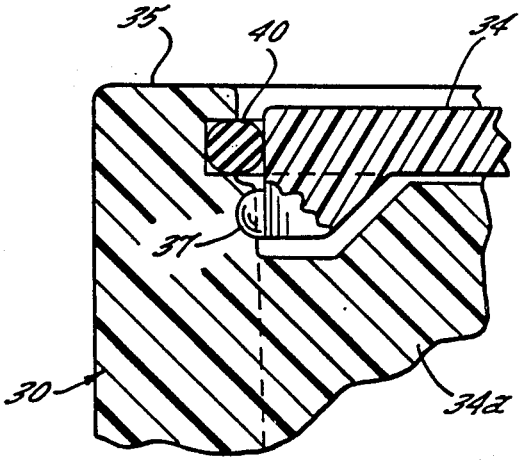
FIG. 6 is an enlarged fragmentary crosssectional view of the valve taken along line 6—6 of FIG. 5.

The cover 34 may be circular in the form of a disk as shown, and normally closes the outer end 35 of the body portion 32. The cover is mounted so as to be movable to an open position in response to sewage effluent backing up within the sewage outflow conduit line 11 and substantially filling the clean-out conduit line 20. Referring to FIG. 5, one way to mount the cover 34 is by using means extending downwardly from the underside of the cover 34 and connected to a pivot 37 so as to permit the cover 34 to have a pivotal axis. The cover has a pivotable axis extending substantially centrally across the circular cover along the diameter thereof. The cover 34 optionally can include weight means 38 carried thereby to bias the over toward a closed position.

Sealing means 40 also may be provided and is preferably carried by the body portion 32 and cooperating with the cover 34 to minimize escapement of noxious sewer gas from the clean-out conduit line 20. This sealing means is typically a rubber O-ring carried within the upper end 35 of the valve body portion 32 and engaging the periphery of the cover 34 when it is in a closed, sealed position.

The body portion 32 may also include a shoulder 43 adjacent the upper end thereof. This shoulder serves as an abutment stop for the cover when the cover is closed. The body portion 32 also may include drain means 44 in communication with the isolated portion of the body portion 32 for draining any effluent or other liquid entrapped in the isolated portion.

In operation, once blockage has occurred, the raw sewage eventually backs up into and substantially fills the clean-out conduit line 20. The cover 32 of the valve 30 is pivotally moved to an open position in response to the sewage effluent. While the valve 30 is in an open position, sewage effluent is released onto the ground preventing the effluent from backing up into the fixtures of the building. When the blockage has been removed and the back up is eliminated, the cover 34 returns to a closed sealed position and the yard and not the building is cleaned up of any sewage.

In the drawings and specification, there has been disclosed a preferred embodiment of the invention and, although specific terms are employed, they are used in a generic and descriptive sense only and not for purposes of limitation, the scope of the invention being set forth in the following claims.

That which is claimed:

1. A waste removal system for a building having at least one waste receiving fixture therein and a waste conduit line connected to said fixture for receiving waste therefrom, said waste removal system comprising a main sewer line extending along the street where the building is located, a sewage outflow conduit line extending from the building and connecting said waste conduit line within the building to said main sewer line, said sewage outflow conduit line being positioned on such a grade that sewage will flow therethrough by gravity and away from the building into said main sewer line, a clean-out conduit line connected to said sewage outflow conduit line and having an upper end extending upwardly from said sewage outflow conduit line and terminating at an elevation below the level of said waste receiving fixture in the building, and a valve comprising a tubular body portion connected to said upper end of said clean-out conduit line, a pivotally mounted circular cover having a pivotable axis extending substantially centrally across the cover along the diameter thereof, said cover normally closing the outer end of said body portion and pivotally movable to an open position in response to sewage effluent backing up within the sewage outflow conduit line and substantially filling said clean-out conduit line and an O-ring carried by said body portion and engaging the periphery of said cover when the cover is in a closed position whereby the problem of sewage effluent backing up through the fixture within the building is avoided.

2. A structure according to claim 1 wherein said tubular body portion is threadably connected to said upper end of said clean-out conduit, and said body portion includes means underlying said cover and isolating a portion of said body portion from flow of effluent therethrough and for limiting the angle of pivotal movement of the cover to an open position, and so that the cover is always biased toward a closed position, and weight means carried by said cover for further biasing the cover to a closed, sealed position.

3. A structure according to claim 1 wherein said body portion has a shoulder adjacent the upper end and serving as an abutment stop for said cover when the cover is moved to closed position and wherein drain means is provided in communication with said isolated portion of said body portion for the draining of any effluent or other liquid entrapped in said isolated portion.

4. A structure according to claim 2 wherein drain means is provided in communication with said isolated portion of said body portion for the draining of any affluent or other liquid entrapped in said isolated portion.

5. A valve adapted to be connected to an end of clean-out conduit line of a waste sewage system for noramlly closing the same and openable in response to sewage effluent backing up within the clean-out conduit line, said valve comprising a tubular body portion having threads on one end thereof adapted for threadable connection to the end of a clean-out conduit line, a circular cover normally closing the other end of said body portion, means carried by said body portion for pivotally mounting said cover thereon, an O-ring carried by said body portion and engaging the periphery of said cover to seal the cover when in a closed position, means underlying said cover and isolating a portion of said body portion from flow of effluent therethrough and for limiting the angle of pivotal movement of the cover to an open position, and so that the cover is always biased toward a closed position, and weight means carried by said cover for further biasing the cover to a closed, sealed position.

* * * * *